US008539889B1

(12) United States Patent
Khalaf Allah et al.

(10) Patent No.: US 8,539,889 B1
(45) Date of Patent: Sep. 24, 2013

(54) CONVERTIBLE TABLE

(71) Applicants: Wesam Khalaf Allah, Almadinah Almunawwarah (SA); Brent Carmichael, Indianapolis, IN (US); Samir Patel, Indianapolis, IN (US)

(72) Inventors: Wesam Khalaf Allah, Almadinah Almunawwarah (SA); Brent Carmichael, Indianapolis, IN (US); Samir Patel, Indianapolis, IN (US)

( * ) Notice: Subject to any disclaimer, the term of this patent is extended or adjusted under 35 U.S.C. 154(b) by 0 days.

(21) Appl. No.: 13/714,681

(22) Filed: Dec. 14, 2012

(51) Int. Cl.
*A47B 3/00* (2006.01)

(52) U.S. Cl.
USPC ..... 108/115; 108/99

(58) Field of Classification Search
USPC ..... 108/115, 15, 12, 11, 99, 25
See application file for complete search history.

(56) References Cited

U.S. PATENT DOCUMENTS

| | | | | | |
|---|---|---|---|---|---|
| 274,162 | A | | 3/1883 | Wilson | |
| 275,598 | A | | 4/1883 | Grandall | |
| 380,366 | A | | 4/1888 | Trapp | |
| 948,905 | A | * | 2/1910 | Snyder | 108/15 |
| 1,779,788 | A | * | 10/1930 | Weston | 108/99 |
| 1,941,579 | A | * | 1/1934 | Reller | 108/15 |
| 2,766,088 | A | * | 10/1956 | Jackson et al. | 108/99 |
| 2,926,794 | A | * | 3/1960 | Karoff | 108/99 |
| 3,095,834 | A | * | 7/1963 | Killen | 108/15 |
| 3,244,124 | A | * | 4/1966 | Accarino et al. | 108/12 |
| 6,019,050 | A | * | 2/2000 | Ranta | 108/115 |
| 6,314,892 | B1 | | 11/2001 | Favini | |
| 6,575,103 | B1 | | 6/2003 | Holdredge et al. | |
| 6,698,364 | B2 | * | 3/2004 | Welch et al. | 108/115 |
| 6,786,162 | B1 | * | 9/2004 | Volkmer et al. | 108/115 |
| 7,510,479 | B2 | * | 3/2009 | Stengel | 108/25 |
| 7,748,328 | B2 | * | 7/2010 | Horton | 108/25 |
| 7,878,128 | B2 | | 2/2011 | Watson et al. | |
| 8,091,488 | B2 | | 1/2012 | Chirea et al. | |
| 8,333,160 | B2 | * | 12/2012 | Lin | 108/25 |
| 2005/0274300 | A1 | * | 12/2005 | Chen | 108/115 |
| 2010/0258042 | A1 | | 10/2010 | Rutz | |
| 2011/0139042 | A1 | | 6/2011 | Korb | |

* cited by examiner

*Primary Examiner* — Jose V Chen
(74) *Attorney, Agent, or Firm* — Oblon, Spivak, McClelland, Maier & Neustadt, L.L.P.

(57) ABSTRACT

A convertible table with two folding legs and two base legs. Each folding leg is rotatably connected to one end of a connection bar, the other end of each connection bar rotatably connected to a respective base leg. A first end of a frame member, which includes a table surface and a writing board, is rotatably attached to top ends of the base legs. A second end of the frame member is rotatably attached to top ends of the folding legs. In a first position, the writing board faces downward and a conventional table is provided with the table surface. In a second position, the folding legs, guided by the connection bars, rotate relative to the frame member and are locked to sides of the frame member by respective locking mechanisms. In the second position, the writing board extends in an upright position and is accessible.

14 Claims, 11 Drawing Sheets

CONVERTIBLE TABLE

GRANT OF NON-EXCLUSIVE RIGHT

This application was prepared with financial support from the Saudia Arabian Cultural Mission, and in consideration therefore the present inventor(s) has granted The Kingdom of Saudi Arabia a non-exclusive right to practice the present invention.

BACKGROUND

1. Field of the Disclosure

The current invention relates to a multi-position folding table that provides a conventional table in one configuration, and a vertically extending writing surface in a second configuration. The table transitions from one configuration to another without the use of any tools or the addition or removal of any components.

2. Description of the Related Art

The "background" description provided herein is for the purpose of generally presenting the context of the disclosure. Work of the presently named inventors, to the extent it is described in this background section, as well as aspects of the description which may not otherwise qualify as prior art at the time of filing, are neither expressly or impliedly admitted as prior art against the present invention.

In academic and professional environments, situations often arise where individuals are aided in the learning process by receiving instructions from professors, peers, training personal, and supervisors. Often times those that instruct use visual diagrams, or demonstrations involving writing out formulas, principles, or conceptual designs on large erasable writing surfaces to aid in explaining subject matter. This often occurs in rooms with walls that incorporate some type of writing surface, such a whiteboard.

While in a classroom for example, a writing surface may be at an instructor's ready disposal. However, often times when students engage in their individual studies outside of the classroom, either independently or in groups, such a platform for demonstration is unavailable. For example, many libraries and schools have open areas with several tables that are used by individuals to layout information to be studied. These schools and libraries may also have separate rooms that provide writing surfaces to use for diagramming and other instructional purposes. Yet, situations may arise during academic activities where demonstration by use of a large erasable writing surface would be beneficial. Those individuals sitting in the large open areas with a multitude of tables may have to collect their things at an instance and move to a room with a large writing surface. The alternative being to forego the opportunity to receive beneficial instruction that may aid their understanding of the subject matter and/or shorten the time spent studying.

In many facilities, providing writing and demonstration tools in the walls of existing rooms may not be feasible due to cost or structural constraints. Thus in order to provide such tools, free standing whiteboards may be used. These tools may take up space and/or be cumbersome to use and then store. In those situations where storage is not feasible, the freestanding whiteboards may have to remain in one location and take up space that could be used for other purposes, such as a table where an individual may study. This may be very undesirable because while the free standing whiteboard has a beneficial use, it will not be used as frequently as a table in the same location. Utilizing space for activities conducted with greater frequency serves as a countervailing interest to providing such types of demonstration and writing tools. There is a need for a device that can be used for multiple functions, one of which lends it self to constant use, and the other of which comes about on an as needed basis and provides a writing surface for demonstration and instructional purposes.

SUMMARY

As described in the description that follows, the convertible table provides a device that solves the problems previously discussed. In a first position, the convertible table is configured to be supported by two base legs and two folding legs, and can be used as a conventional table. The convertible table can be transformed into an upright and freestanding writing board, by placing the convertible table in a second position (without the use of any tools or additional parts).

Reconfiguring the convertible table from a first position to a second position can be accomplished on an as needed basis by lifting a table frame assembly. The table frame assembly rotates about its connections with the two base legs, and is comprised of at least two surfaces, including a table surface and a writing board. When the convertible table is in a first position (as a table), the table surface faces upwards, and can be used as the top of a conventional table. A writing board is located on the opposite side of the table frame assembly as the table surface, and faces downwards in the first position. In a second position, the writing board extends along a vertical plane at a right angle to the floor which supports the convertible table.

When the table frame is lifted, two connection bars guide the movement of the folding legs downward and to the sides of the table frame assembly. Each connection bar is connected at one end to a base leg, and at an opposite end to a folding leg. Locking mechanisms between the folding legs and the table frame assembly hold the folding legs in place in the second position. The locking mechanisms may include a spring loaded locking pin located on each folding leg. The locking pin either automatically or manually gets inserted into a locking aperture provided on a respective side of the table frame assembly, when the convertible table is moved into a second position. Alternatively, a spring loaded locking pin may be provided on each side of the table frame assembly, and a locking aperture that receives a respective locking pin is provided in each folding leg.

In the first exemplary embodiment of the convertible table, one writing board is provided. In a second exemplary embodiment, at least two writing boards are inserted into slots provided on an end of a table frame assembly connected to a pair of folding legs. The first and second writing boards can slide, and portions of each can move in and out of the table frame assembly, when the end of the table frame assembly with the slots is not covered by a cover plate. In a closed position the cover plate covers the end of the table frame assembly with the slots. The cover plate is moved from the closed position, by applying a force on the cover plate in the direction of the table frame assembly and then releasing the cover plate. Once released, the cover plate will extend away from the table frame assembly under the bias of springs, which load telescoping plate connections attached to the cover plate. As a result, once extended, the cover plate can be rotated in either direction about an axis of rotation of the folding legs, and the end of the table frame assembly connected to the folding legs and including the slots will be open.

When the convertible table of the second embodiment is in the first position or the second position, and the cover plate is in the closed position, the first and second writing boards are secured within the table frame assembly. When the convertible table of the second embodiment is in the first position or the second position, and the end of the table frame assembly with the slots is open, the first and second writing boards (or at least portions thereof) can move in and out of the end of the table frame assembly with the slots.

The foregoing paragraphs have been provided by way of general introduction, and are not intended to limit the scope of the following claims. The described embodiments, together with further advantages, will be best understood by reference to the following detailed description taken in conjunction with the accompanying drawings.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE EMBODIMENTS

Figure 1:
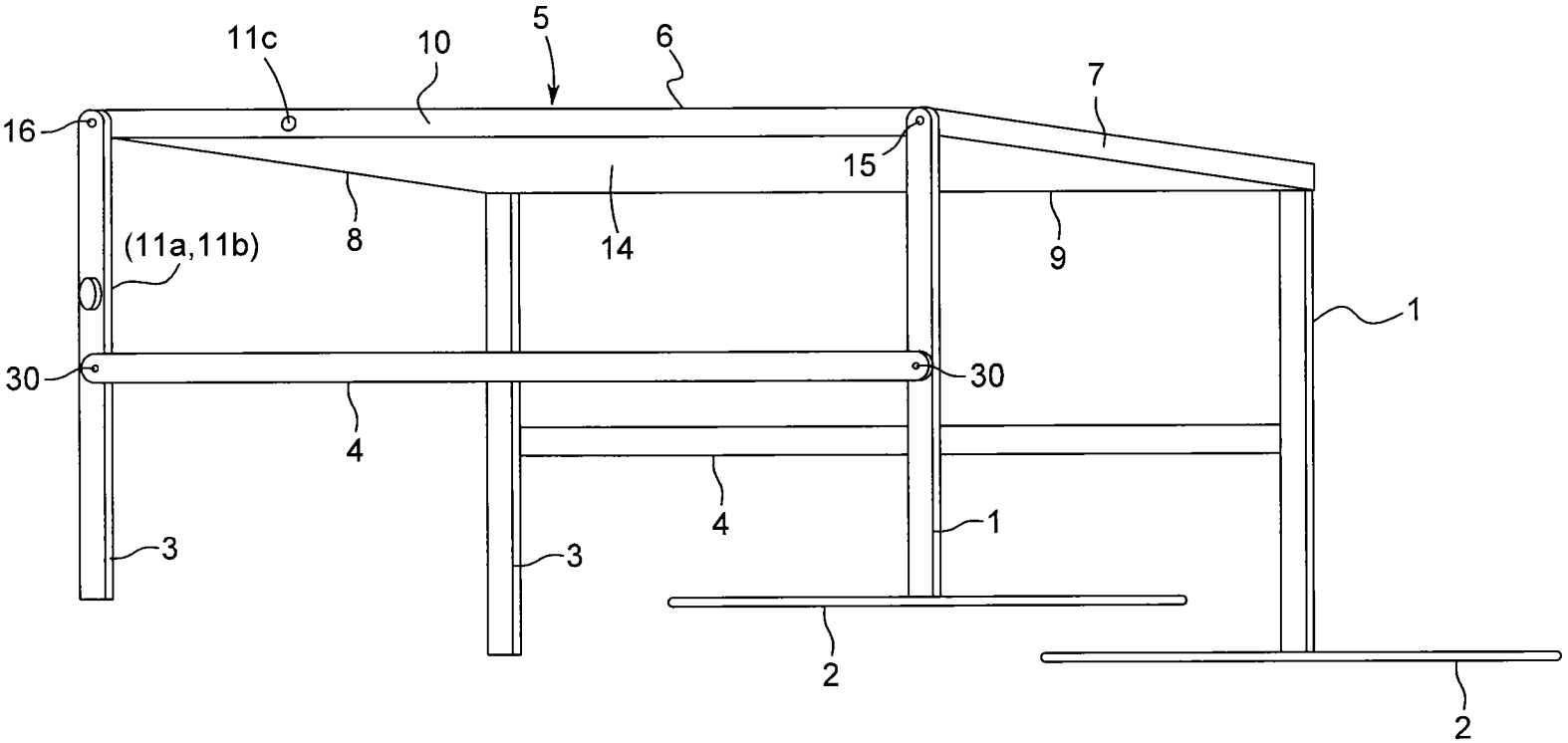
FIG. 1 illustrates a first exemplary embodiment of a convertible table in a first position.

Referring now to the drawings, wherein like reference numerals designate identical or corresponding parts throughout the several views of the convertible table of the present invention. The following description relates to a convertible table that includes a table frame assembly, a pair of base legs, a pair of folding legs, a pair of connection bars, a table surface, and at least one writing board. The table surface can be formed of any material including wood, wood composite, plastic, etc., which can be used to provide a table top of a conventional table. The writing board may be a dry-erase board (also known as a "markerboard," "whiteboard," or "dry-wipe board"), on which dry-erase markers can be used to make erasable writings. However the instant invention is not limited to dry-erase types of surfaces, and may include other writing surfaces such as a chalkboard.

Each base leg includes a bottom end connected to a base support, and a top end rotatably connected to one side of a first end of a table frame assembly. The top end of each base leg is connected to the table frame assembly by a base pivot joint assembly. The base pivot joint assemblies allow the table frame assembly to pivot about the base legs from a first position to a second position.

Each folding leg includes a top end that is rotatably connected to one side of a second end of the table frame assembly by a floating pivot joint assembly. The floating pivot joint assemblies allow each folding leg to rotate from a position extending perpendicular to the table frame assembly in the first position, to a position extending parallel to the table frame assembly in the second position. Once parallel to the table frame assembly, the folding legs are locked in place by locking mechanisms.

Each connection bar includes a first end connected to one of the base legs by a pin connection, and an opposite second end connected to a folding leg by a pin connection. Each connection bar guides the movement of a respective folding leg.

The table surface extends from the first end to the second end of the table frame assembly. The sides of the table frame assembly, connected to the base legs and folding legs by respective pivot joint assemblies, extend from the edges of the table surface. The at least one writing board faces the opposite direction as the table surface, and can be formed with the sides of the table frame assembly. In the alternative, the writing board can be one of two or more separate panels detached from the table frame assembly. In this embodiment the writing board(s) will be located within the space defined by the sides of the table frame assembly.

In the first position the writing board faces downwards, and the table surface faces upwards to provide a horizontal surface supported at each corner by a respective base or folding leg. For the convertible table to be moved into the second position, the table frame assembly, table surface, and the writing board pivot about the top ends of the base legs until the table frame assembly is in an upright position. The entire table frame assembly is able to remain in an upright position because of the support provided by base plates connected to the bottom ends of the base legs, and the locking mechanisms that lock folding legs to the table frame assembly.

FIG. 1 is a view of a first exemplary embodiment of the present invention in a first position. The table frame assembly 5 is comprised of a table surface 6, a writing board 14, a first table end 7, a second table end 8, a first side frame member 9, and a second side frame member 10. The first table end 7 of the table frame assembly 5 is connected to two base legs 1 by base pivot joint assemblies 15. Each of the first side frame 9 and the second side frame 10 are respectively attached to base pivot joint assemblies 15. Each base leg 1 is connected to a connection bar 4 by a connecting pin 30 at one end of the connection bar 4. A connection pin 30 connects the other end of each connection bar 4 to a folding leg 3. One end of each folding leg 3 is connected to the second table end 8 of the table frame assembly 5 by a floating pivot joint assembly 16. In a first position the table frame assembly 5 extends parallel to a floor, and the folding legs 3 rest on the floor.

Figure 2A:
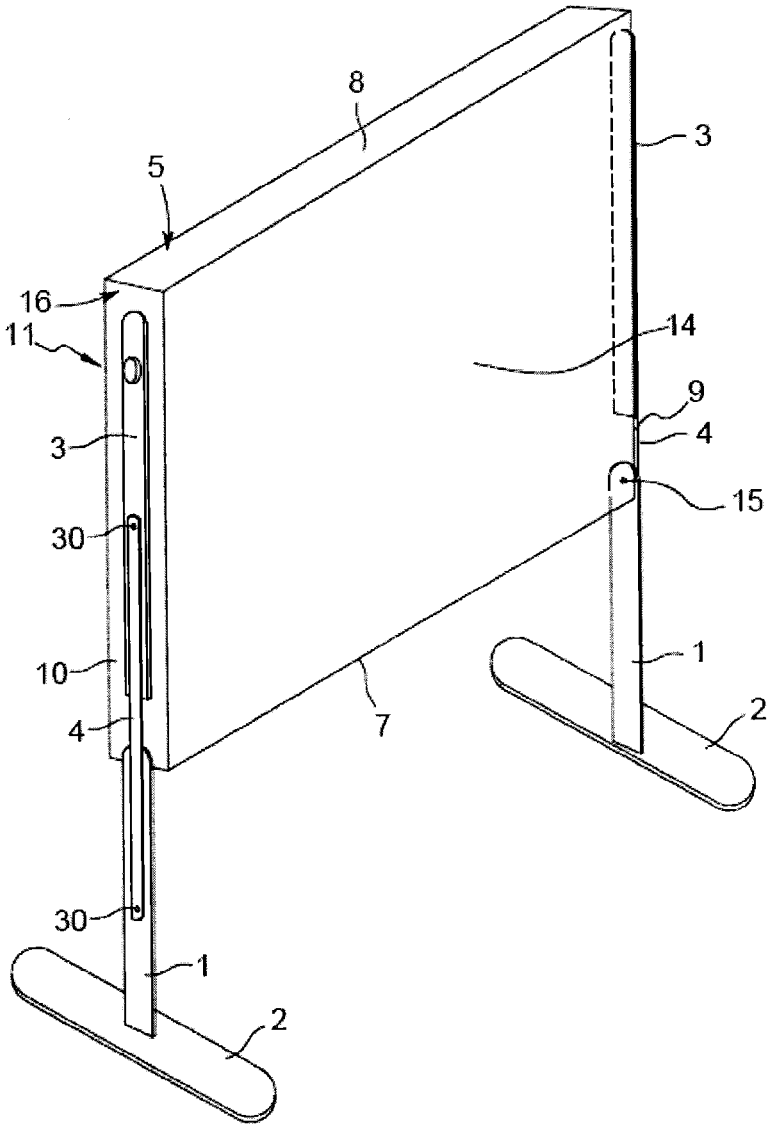
FIG. 2A illustrates the convertible table according to the first embodiment in a second position.

FIG. 2 illustrates a view of the first exemplary embodiment of the present invention in a second position. In the second position base supports 2 on the lower ends of the base legs 1 support the table frame assembly 5 in an upright position. The floating pivot joint assemblies 16 allow each folding leg 3 to rotate and be guided by the connection bar 4 it is connected to. A locking mechanism 11 is provided between each folding leg 3 and the side frame members (9, 10) of the table frame assembly 5. The folding legs 3 rotate towards the table frame assembly 5 and are locked in place by the locking mechanisms 11 in the second position. The connection bars 4 remain on the outside of the base legs 1 and the folding legs 3. With the table frame assembly 5 in an upright position, the writing board 14 is vertically displayed and easily accessible for writing on. The writing board 14 may be a dry-erase board as would be recognized by one of ordinary skill in the art (also known as a markerboard, whiteboard, or dry-wipe board). Thus, in a first position the convertible table can be used as a standard table, and in the second position the convertible table can be used as a writing surface.

Figure 2B:
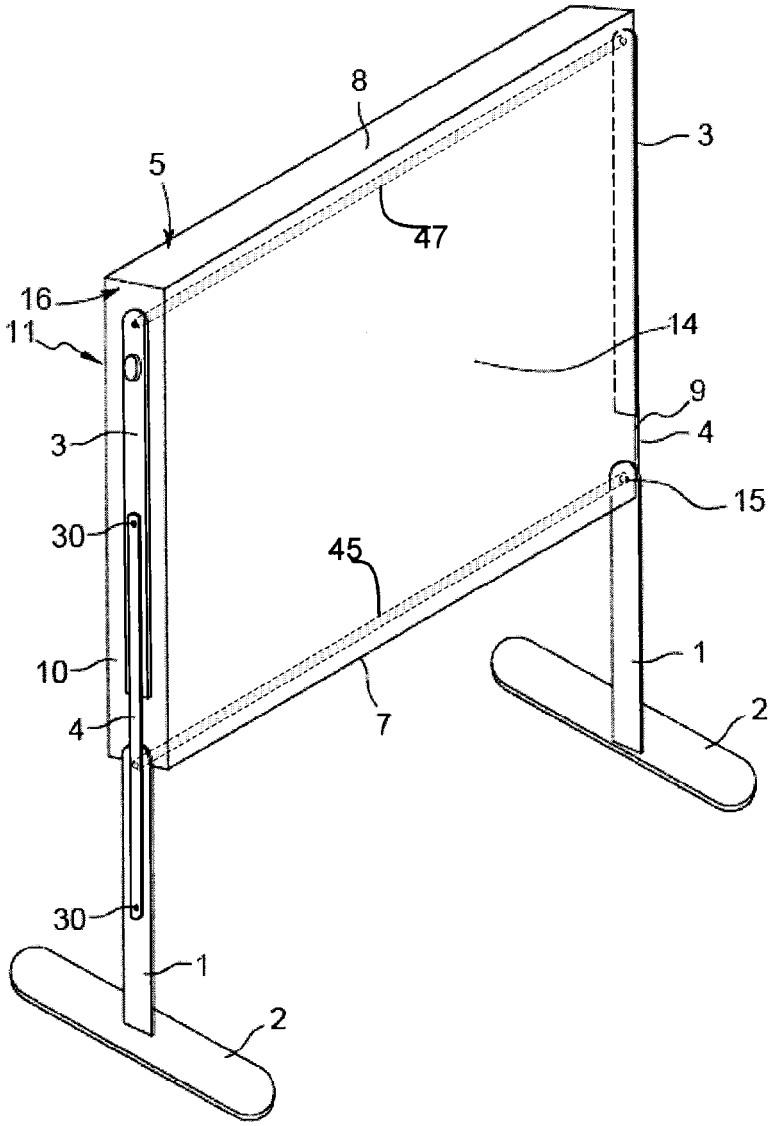
FIG. 2B illustrates a modified first embodiment of the convertible table in the second position.

To add structural support and stability, in the modified first exemplary embodiment illustrated in FIG. 2B, the base legs 1 are connected by a rotational bar or rod 45 that extends within the first table end 7 of the table frame assembly 5 between table surface 6 and the writing board 14. The rotational bar or rod 45 extends through first side frame member 9 and second side frame member 10 to connect the base legs 1, and provide the base pivot joint assemblies 15. In a similar construction, another rotational bar or rod 47 connects the folding legs 3, and provides the pivot joint assemblies 16 by extending within the second table end 8.

The first embodiment of the convertible table provides a table that can be converted into a free standing writing and demonstration tool whenever needed. This dual usage obviates the need for added space (either storage or floor space) to accommodate a single free-standing whiteboard, or the alteration of walls within classrooms or conference rooms which do not include whiteboards. If a room has multiple convertible tables, and a situation arises for which demonstration on a whiteboard would be beneficial, individuals need only reconfigure one of the convertible tables from a first position to a second position. Moving from the first position to the second position only requires lifting the end of the convertible table with a pair of folding legs connected, and locking the folding legs in place. Locking the folding legs could occur automatically depending on the type of lock mechanism used. Thus the convertible table of the first embodiment provides a convenient solution for providing a demonstration tool that requires a simple procedure to implement.

Figure 3A:
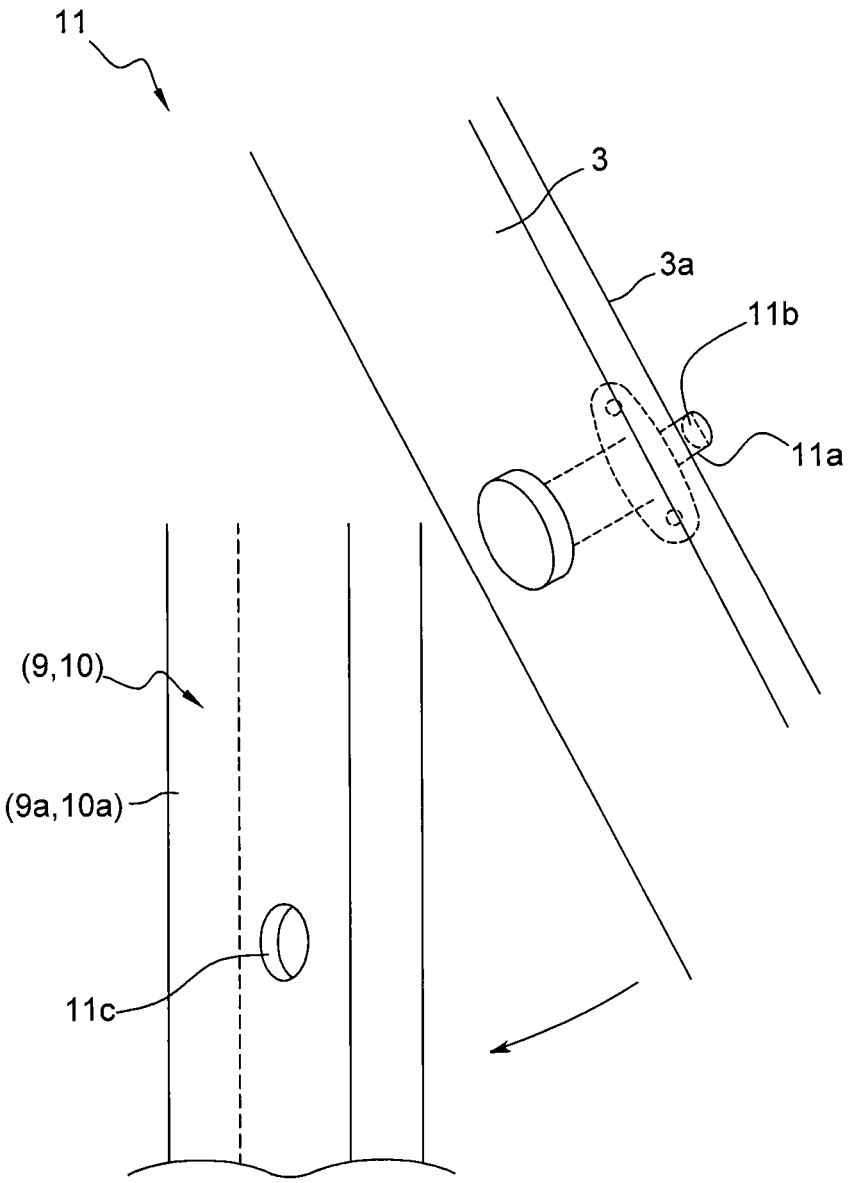
FIGS. 3A-3C illustrate exemplary embodiments of a locking mechanism.
Figure 3B:
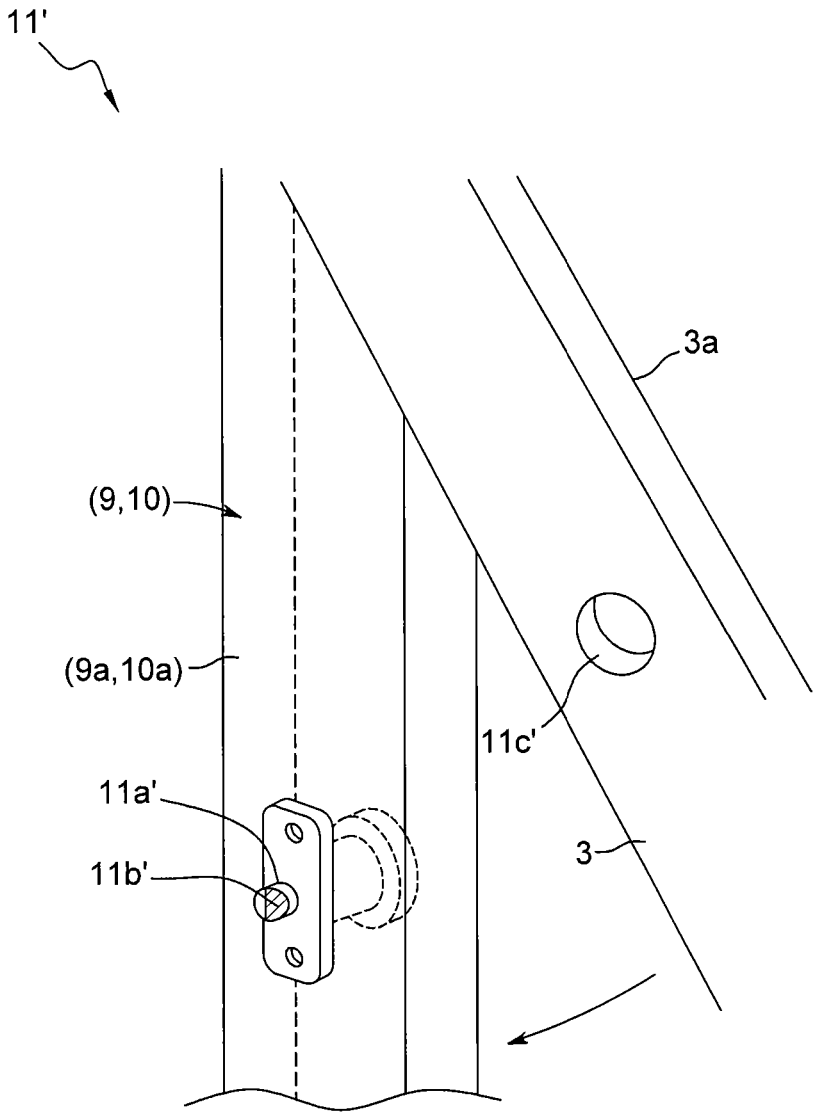
Figure 3C:
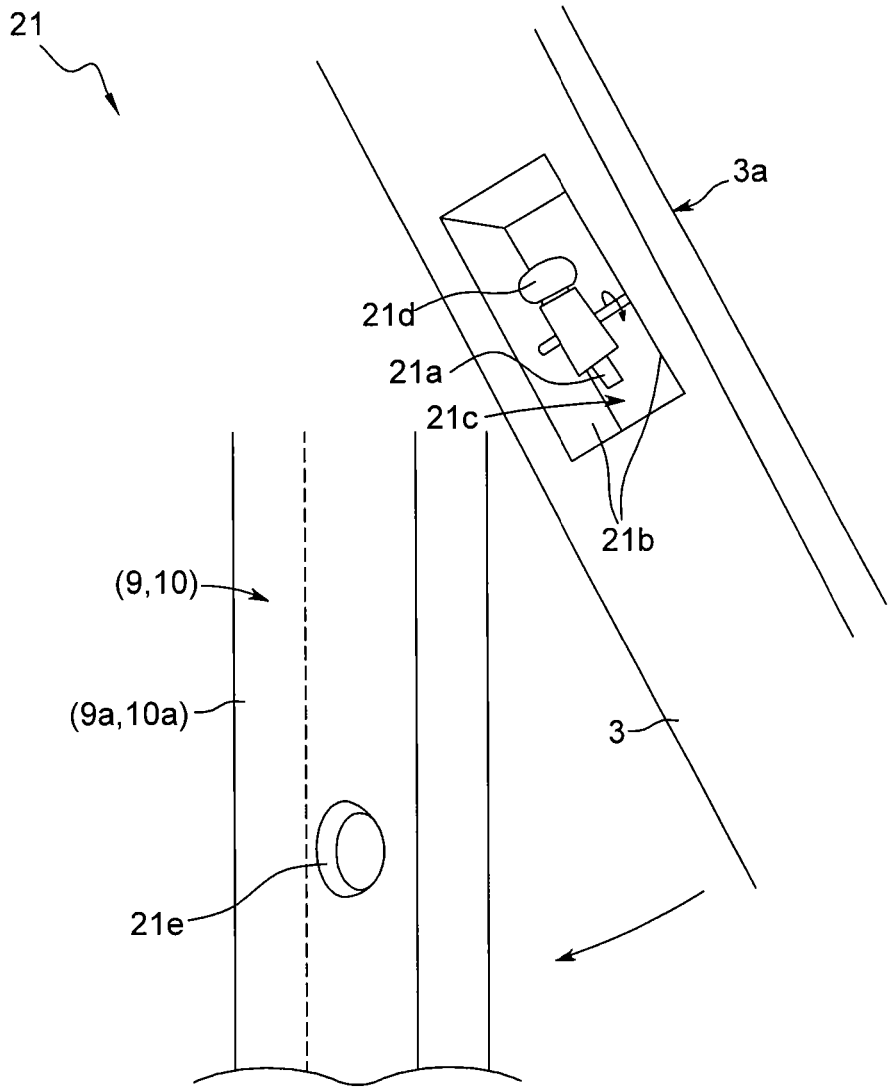

FIGS. 3A-3C illustrate different embodiments for a locking mechanism. FIGS. 3A-3C contain elements identical to those described and illustrated in FIGS. 1 and 2, and therefore like designations are repeated.

FIG. 3A shows a first embodiment of a locking mechanism 11 of the present invention. In the embodiment of FIG. 3A, a locking pin 11*a* that is spring loaded and has a beveled edge 11*b*, extends from an inner surface 3*a* of the folding leg 3. When the folding leg 3 is rotated into place, the beveled edge 11*b* of the locking pin 11*a* contacts the side of the table frame assembly 5 and is pushed backwards into a respective folding leg 3. The folding leg 3 will continue to rotate until the locking pin 11*a* progresses over the locking aperture 13, at which point the locking pin 11*a* is biased into the locking aperture 11*c* by the spring of the locking mechanism 11. The locking pin 11*a* will progress over, and be in line with (i.e. coaxial), the locking aperture 13 when the folding leg 3 extends parallel to a respective side frame member (9, 10) of the table frame assembly. The beveled edge 11*b* of the locking pin 11*a* allows the locking pin 11*a* to be moved into a locked position automatically without having to be pulled. Thus locking pins 11*a* will move with the folding legs 3, and are automatically pushed into locked positions, once the folding legs 3 extend parallel to the table frame assembly 5.

FIG. 3B shows a second embodiment of a locking mechanism 11' of the present invention. In the embodiment of FIG. 3B, a locking pin 11*a*' that is spring loaded and has a beveled edge 11*b*', extends from an outer surface (9*a*, 10*a*) of the side frame members (9, 10) of the table frame assembly 5. A locking aperture 11*c*' is formed in the folding legs 3. As the folding legs 3 rotate as the table frame assembly 5 is moved into the second position, the beveled edge 11*b*' of the respective locking pin 11*a*' contacts the inner surface 3*a* of the respective folding leg 3. This causes the locking pin 11*a*' to be retracted into the table frame assembly 5. Each locking pin 11*a*' on each side frame member (9, 10) remains retracted until the locking aperture 11*c*' of the respective folding leg 3 progresses over, and is in line with (i.e. coaxial), the locking pin 11*a*'. Once in line, the locking pin 11*a*' extends as a result of the biasing force applied by the spring of the locking pin 11*a'*.

FIG. 3C illustrates a third embodiment for a locking mechanism 21 of the present invention. In the embodiment of FIG. 3C, a locking pin 21*a* is spring loaded and rotatably connected to the longitudinal walls 21*b* defining a lock recess 21*c* formed within each folding leg 3. When the convertible table is moved into the second position, the locking pin 21*a* can be moved into a locking position by manually pulling an end of the locking pin 21*a* attached to a knob 21*d*, rotating the locking pin 21*a* in a direction away from the inner surface 3*a* of the folding leg 3 until the locking pin 21*a* is in line with (coaxial to) a locking aperture 21*e*, and releasing the knob 21*d*. Once released, the spring of the locking ping 21*a* will push the locking pin 21*a* into the locking aperture 21*e* formed in the side frame member (9, 10) of the table frame assembly 5, and lock the folding leg 3 to the side frame member (9, 10).

The locking pin 21*a* of the third embodiment may also include a beveled edge (not shown). In this alternative, when the convertible table is in the second position and the end of the locking pin 21*a* with the knob 21*d* is rotated away from the inner surface 3*a* of folding leg 3, the beveled edge of the locking pin 21*a* will contact the side frame member (9, 10). The locking pin 21*a* will progressively retract until it is in line with the locking aperture 21*e*, at which point the spring of the locking pin 21*a* will cause the locking pin 21*a* to extend into the locking aperture 21*e* and the locked position. This obviates the need to pull the knob 21*d* while the locking pin 21*a* is being rotated into the locked position.

The embodiments of the locking mechanism illustrated in FIGS. 3A-3C can be applied to any of the embodiments disclosed herewith of the convertible table. The first embodiment illustrated in FIG. 3A, and the second embodiment illustrated in FIG. 3B provide automatic locking mechanisms. In these embodiments a locking pin (11*a*, 11*a*') is pressed into a retracted position by contact with either a side frame member (9, 10) or a folding leg 3 that is rotating towards the table frame assembly 5. Once the locking pins (11*a*, 11*a*') in the embodiments of FIGS. 3A and 3B come in line with corresponding locking apertures (11*c*, 11*c*'), a spring advantageously causes the locking pins (11*a*, 11*a*') to automatically extend into the locking apertures (11*c*, 11*c*') and a locked position.

The third embodiment of the locking mechanism 21, illustrated in FIG. 3C, does not include the feature of a locking pin that is automatically moved into a locking position when the convertible table is moved from the first position to the second position (i.e. when the folding legs 3 are moved towards the table frame assembly 5). However, the third embodiment does include the feature of a locking pin 21*a* that is concealed within the folding legs 3 when the convertible table is in the first position. When the convertible table is in the first position, and a locking pin 21*a* extends along a longitudinal axis the folding leg 3, no portion of the locking pin 21*a* protrudes outside of the folding leg 3. The thickness of the folding leg 3 defines a space that encloses the locking pin 21*a*. Therefore, with the third embodiment of a locking mechanism, a spring loaded and retractable locking pin does not extend from either the folding legs 3 or the side frame members (9, 10), when the convertible table is in the first position.

Figure 4:
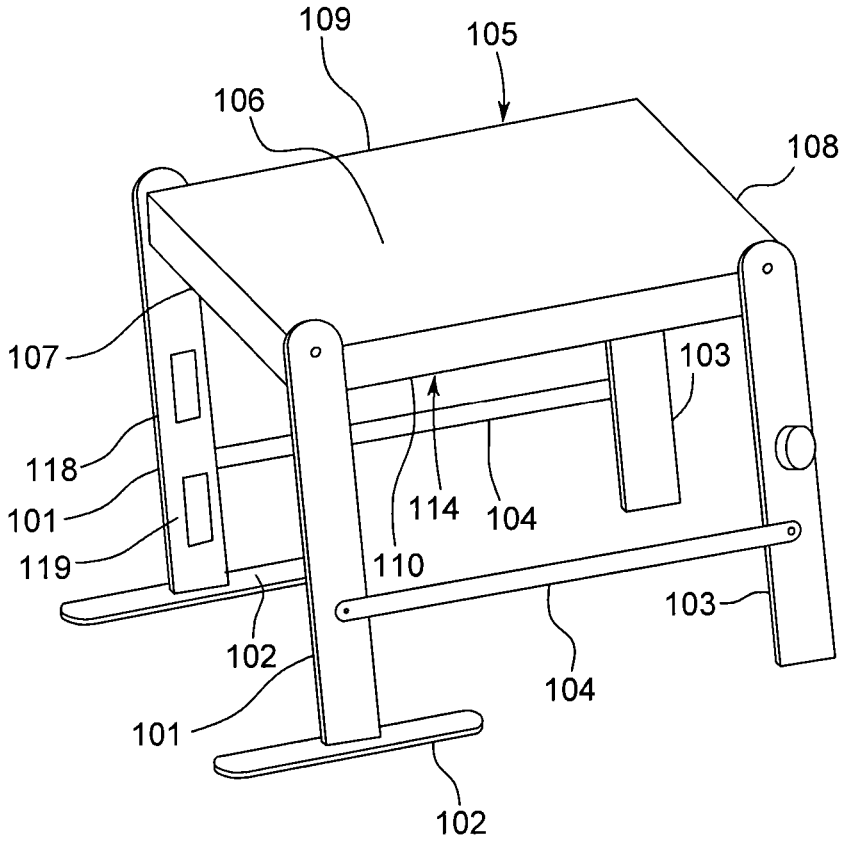
FIG. 4 illustrates a second exemplary embodiment of a convertible table in a first position.

FIG. 4 illustrates a second embodiment of the present invention in a first position. In the second embodiment a table frame assembly 105 is comprised of a first table end 107, a second table end 108, and side frame members (109, 110). The side frame members 109 and 110 have an appreciable width such that there is an appreciable space between a table surface 106 and a first writing board 114. Thus the table frame assembly 105 may house multiple writing boards 114.

Figure 5:
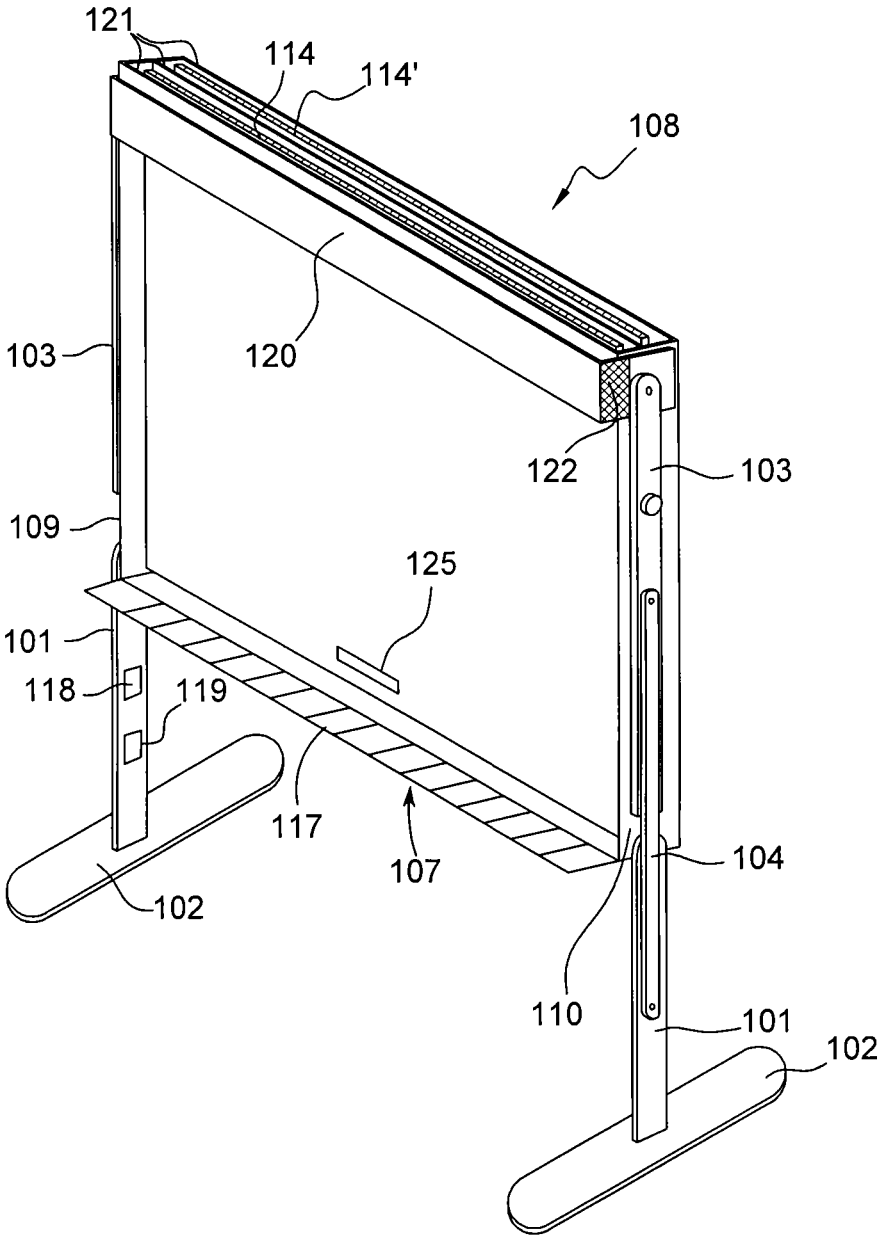
FIG. 5 illustrates the convertible table according to the second embodiment in a second position.
Figure 6:
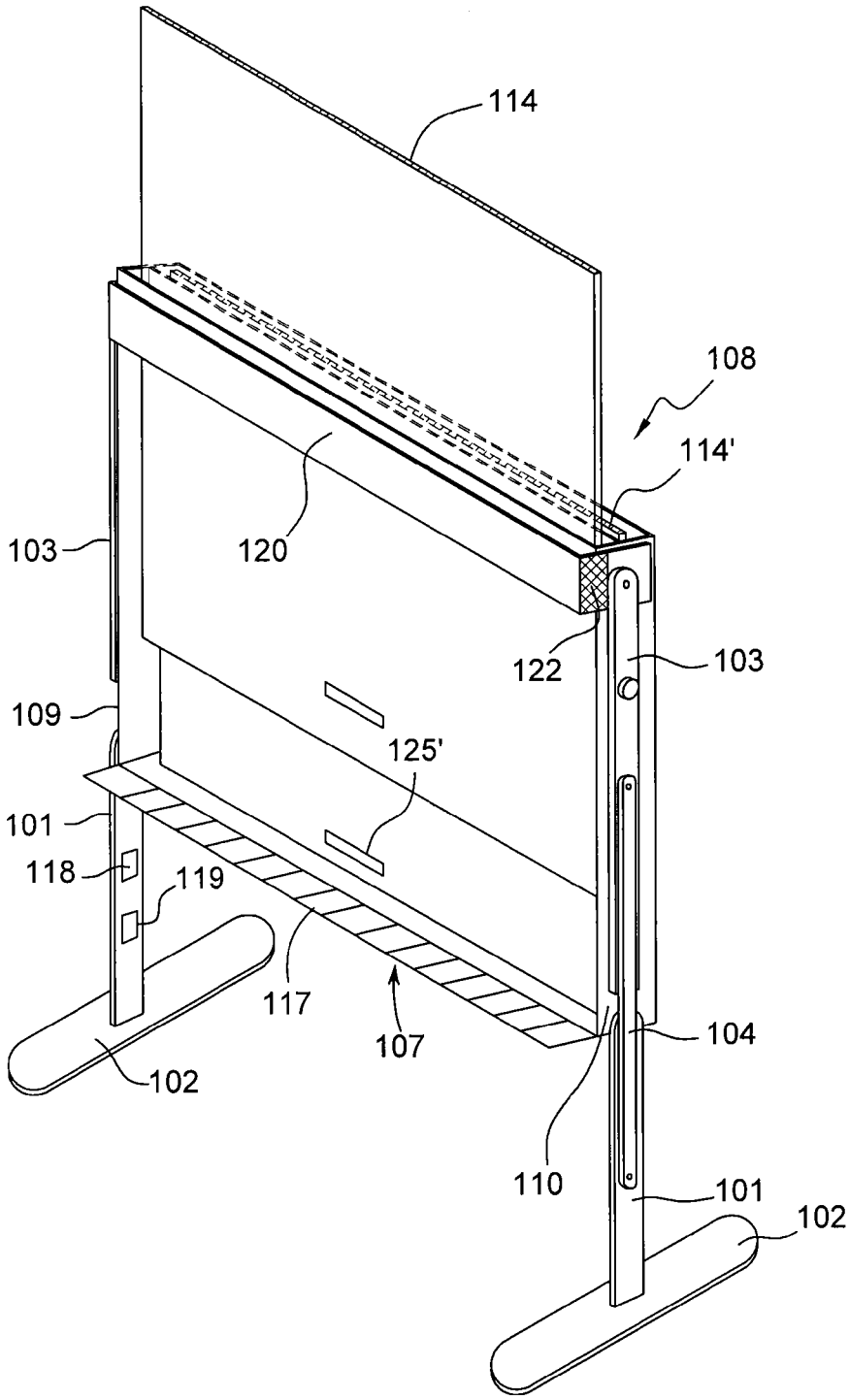
FIG. 6 illustrates another view of the convertible table according to the second embodiment in the second position.

FIGS. 5 and 6 illustrate the second embodiment of the present invention in a second position. The second table end 108 includes frame slots 121 that receive the first writing board 114 and a second writing board 114'. In the second position, the first writing board 114 and the second writing board 114' are able to slide up and down within the frame slots 121 in the table frame assembly 105. The first writing board 114 can be moved upwards by the use of a handle 125. Once it is moved upward as shown in FIG. 6, the second writing board 114' is accessible and can be written on. A track system, as known in the art, may be provided between the inner surfaces of the side frame members (109, 110) and the vertically extending edges of the writing boards (114, 114'). Said track system enabling the writing boards (114, 114') to be positioned at various vertical locations, without the use of any external tools or equipment that serve to suspend the writing boards (114, 114').

The base legs 101 and connection bars 104 of the second embodiment of the convertible table, and the base legs 1 and connection bars 4 of the first embodiment, operate the same way. At the base of the table frame assembly 105, as illustrated in FIGS. 5 and 6, there is provided a tray 117. In the second position the tray 117 can be used to hold markers, erasers, and other objects. Recesses (118, 119) on the inner surface of the base legs 101 provide storage spaces that can be used to store erasers and markers.

Figure 7:
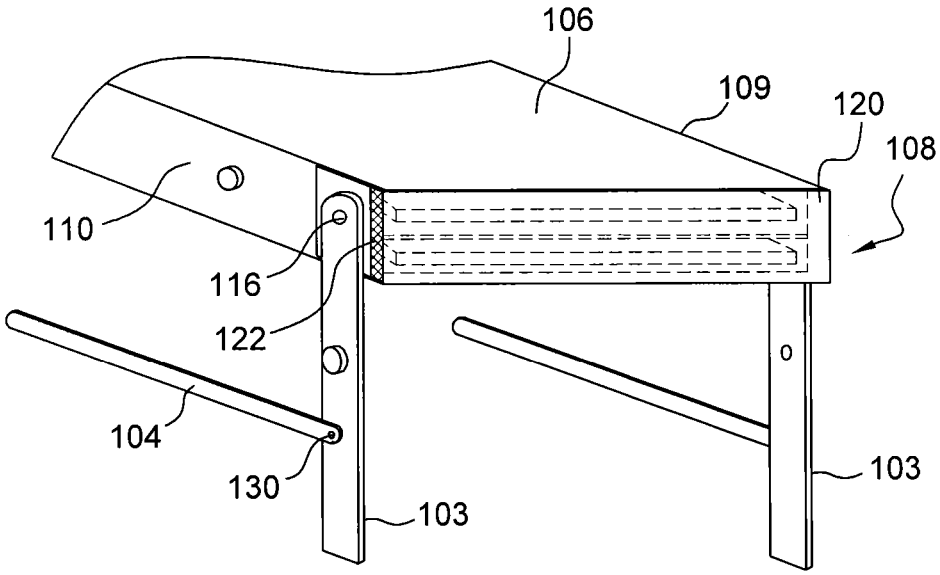
FIG. 7 illustrates an alternative view of the convertible table according to the second embodiment in the first position, with a cover plate in a closed position.
Figure 8:
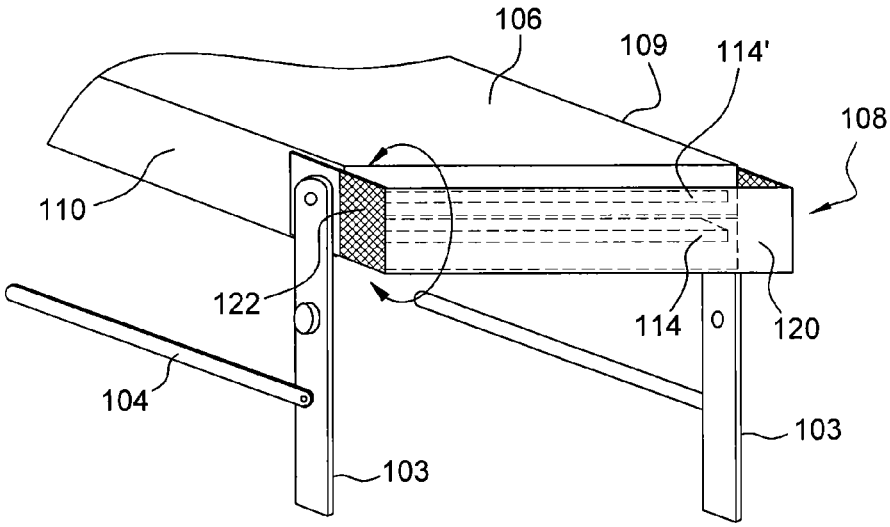
FIG. 8 illustrates another view of the convertible table according to the second embodiment in the first position, with the cover plate in an extended position.
Figure 9:
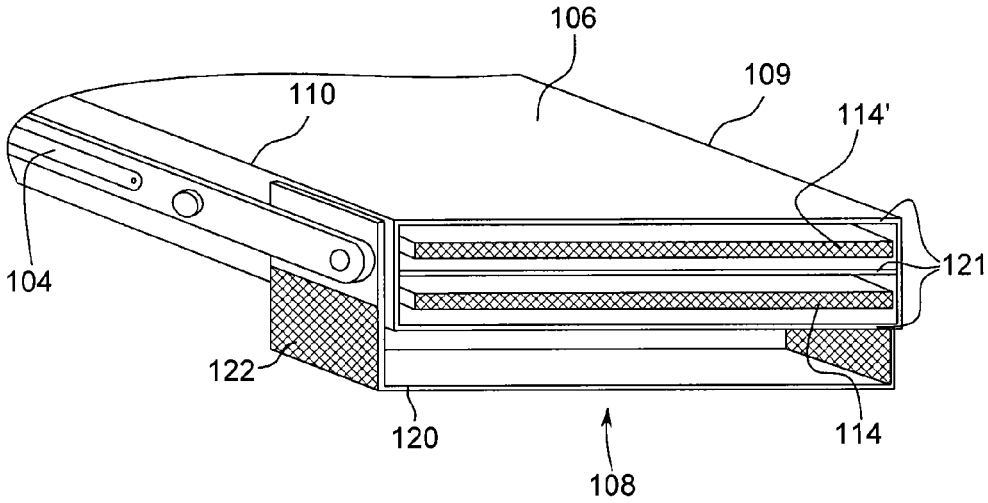
FIG. 9 illustrates a close-up view of a second end of the convertible table according to the second embodiment in the second position.

FIG. 7-9 illustrate the operation of a cover plate 120 connected to the table frame assembly 105 by telescoping plate connections 122. In the first position or second position, once the cover plate 120 is in an extended position, the cover plate 120 can be rotated in either direction about a rotational axis of the folding legs 103. When the cover plate 120 is rotated and extends parallel to the table frame assembly 105, the second table end 108 is open and the first writing board 114 and the second writing board 114' are able to slide and extend through the second table end 108.

FIG. 7 illustrates a close-up of the second table end 108 of the second embodiment of the present invention in the first position. In a closed position, the cover plate 120 conceals the ends of the first writing board 114 and the second writing board 114'. The cover plate 120 is held closed against the second table end 108 by a press release lock including the telescoping plate connections 122, which are spring loaded. When the cover plate 120 is in a closed position, then pressed in the direction of the second table end 108 and released, the telescoping plate connections 122 are released from a locked position and extend under the bias of springs. As a result, the cover plate 120 moves away from the second table end 108. Pressing the cover plate 120 towards the second table end 108 from an extended position, will cause the telescoping plate connections 122 to retract into the locked position, and the second table end 108 to be closed by the cover plate 120.

FIG. 8 illustrates the convertible table in the first position, and the cover plate 120 in an extended position after it has been pressed and released from the closed position. In the extended position, the cover plate 120 and the telescoping plate connections 122 can rotate about the rotational axis of the folding legs 103. The cover plate 120 and the telescoping plate connections 122 rotate independently of the folding legs 103. Thus, in the first position, the cover plate 120 can be extended and rotated downward to open the second table end 108. This allows an individual to pull out either writing board (114, 114') through the frame slots 121. Therefore, if both surfaces of each writing board (114, 114') are the same (i.e. both sides of a writing board is of a dry-erase surface type), the writing boards (114, 114') can be pulled out and used as needed for writing equations, diagrams, instructions, etc., while individuals are sitting at the convertible table of the second embodiment in the first position.

The cover plate 120 can remain in the closed position while the convertible table changes from the first position to the second position because it rotates independently of the rotational movement of the folding legs 103. If the convertible table is in the second position, and the cover plate 120 is in the closed position, pressing downward on the cover plate 120 toward the second table end 108 will release the telescoping plate connections 122 from the locked position. The cover plate 120 will extend upwards once the downward pressure is withdraw. Once the cover plate 120 is extended and rotate downward, as shown in FIGS. 5, 6, and 9, the second table end 108 will be open, and the writing boards (114, 114') can be moved up and down through the frame slots 121. It is noted that in FIGS. 5, 6, and 9 the cover plate 120 has been rotated in the same direction the folding legs 103 rotate about the rotational axis of the folding legs 103. If rotated in this direction, the cover plate will be disposed in front of the writing boards (114, 114') as shown. However, the cover plate 120 can also be rotated in the opposite direction and disposed in front of the table surface 106.

FIG. 9 illustrates another view of the second table end 108 when the table frame assembly 105 is in the second position, and the cover plate 120 has been extended and rotated downward. As can be seen from FIG. 9, the second table end 108 is left exposed so that the first writing board 114 and the second writing board 114' can be moved through the slots 121 and out of the second table end 108.

In addition to the advantages of the first embodiment, an advantage of the second embodiment of the convertible table is that the first and second writing boards (or at least portions thereof) can move in and out of the end of the table frame assembly with the frame slots. This feature can be used to increase the total area that may be written on, and viewed at the same time. For example, in the second position, when the end of the table frame assembly with the frame slots is open, the first writing board can move upwards to reveal the second writing board. Thus when an individual fills the first writing board with words, equations, or diagrams, it will not be necessary to erase areas of the first writing board in order to add more subject matter. The individual will merely move the first writing board up through the end of the table frame assembly with the frame slots, to reveal the second writing board.

Another advantage of the second embodiment is that the writing boards can be used when the convertible table is in the first or second position, if the end of the table frame assembly with the frame slots is open. As discussed above, if both surfaces of each writing board are the same (i.e. both sides of a writing board are dry-erase or chalkboard type surfaces), when the convertible table is in the first position, individuals sitting at the convertible table can pull out writing boards to be used for writing equations, diagrams, instructions, etc. as needed.

Thus, the foregoing discussion discloses and describes merely exemplary embodiments of the present invention. As will be understood by those skilled in the art, the present invention may be embodied in other specific forms without departing from the spirit or essential characteristics thereof. Accordingly, the disclosure of the present invention is intended to be illustrative, but not limiting of the scope of the invention, as well as other claims. The disclosure, including any readily discernible variants of the teachings herein, define, in part, the scope of the foregoing claim terminology such that no inventive subject matter is dedicated to the public.

The invention claimed is:

1. A convertible table comprising:

a first leg;

a second leg;

a first base leg including a first main body and a first support plate attached to a bottom end of the first main body, the first support plate extending along a first axis that intersects and is perpendicular to a longitudinal axis of the first base leg;

a second base leg including a second main body and a second support plate attached to a bottom end of the second main body, the second support plate extending along a second axis that intersects and is perpendicular to a longitudinal axis of the second base leg;

a first connection bar having a first end rotatably attached to a first section of the first leg and a second end rotatably attached to the first main body;

a second connection bar having a first end rotatably attached to a first section of the second leg and a second end rotatably attached to the second main body;

a frame member extending between a top end of the first leg, a top end of the second leg, a top end of the first base leg, and a top end of the second base leg, wherein a first end of the frame member is rotatably attached to the top end of the first base leg and the top end of the second base leg, and a second end of the frame member is rotatably attached to the top end of the first leg and the top end of the second leg;

a first surface extending from the first end of the frame member to the second end of the frame member; and a second surface extending from the first end of the frame member to the second end of the frame member, wherein, in a first position, a longitudinal axis of the first connection bar and a longitudinal axis of the second connection bar are parallel to the first axis and the second axis, in a second position, the first leg and the second leg rotate relative to the frame member, and the longitudinal axis of the first connection bar and the longitudinal axis of the second connection bar extend in a direction parallel to a longitudinal axis of the first leg, a longitudinal axis of the second leg, the longitudinal axis of the first base leg, and the longitudinal axis of the second base leg, one of the first surface and the second surface defines a first writing surface, and the second end of the frame member includes a plurality of slots extending across the second end from a first side of the frame member to a second side of the frame member, and the first writing surface is removably inserted into a first slot of the plurality of slots.

2. The convertible table of claim 1 further comprising:

a first lock mounted on the first leg and having a first pin, wherein in the second position, the first pin extends from the first leg into a first receiving hole formed on a first side of the frame member to affix the first leg to the first side.

3. The convertible table of claim 2, further comprising:

a second lock mounted on the second leg and having a second pin, wherein in the second position, the second pin extends from the second leg into a second receiving hole formed on a second side of the frame member to affix the second leg to the second side.

4. The convertible table of claim 3, wherein the first leg includes:

a first recess formed within and extending through the first leg, and wherein the first lock is rotatably mounted within the first recess, when the first lock is in an unlocked position and the first pin extends parallel to the longitudinal axis of the first leg the first lock is entirely enclosed by the first recess, and when the first lock is in a locked position when the convertible table is in the second position, the first lock is rotated within the first recess to be orthogonal to the longitudinal axis of the first leg and the first pin extends through the first receiving hole.

5. The convertible table of claim 4, wherein the second leg further comprises:

a second recess formed within and extending through the second leg, and wherein the second lock is rotatably mounted within the second recess, when the second lock is in an unlocked position and the second pin extends parallel to the longitudinal axis of the first leg the second lock is entirely enclosed by the second recess, and when the second lock is in a locked position when the convertible table is in the second position, the second lock is rotated within the second recess to be orthogonal to the longitudinal axis of the second leg and the second pin extends through the second receiving hole.

6. The convertible table of claim 1, wherein the first surface extends on one side of the frame member, the second surface extends on an opposite side of the frame member, and in the first position the first surface and the second surface are parallel to the first axis and the second axis, and in the second position the first surface and the second surface are perpendicular to the first axis and the second axis.

7. The convertible table of claim 6, wherein the one of the first surface and the second surface that defines the first writing surface is an erasable writing surface comprised by a dry-erase board, and the other of the first surface and the second surface is a table surface.

8. The convertible table of claim 1, further comprising:

a cover plate on the second end of the frame member that covers the plurality of slots in a closed position, wherein the cover plate is held in a closed position by a press release lock, and in an extended position the cover plate can rotate such that the second end of the frame member and the plurality of slots are not covered by the cover plate.

9. The convertible table of claim 8, wherein the frame member includes:

a third surface separate from the first surface and the second surface, the third surface being removably inserted into a second slot of the plurality of slots between the first surface and second surface, wherein the third surface is a second writing surface disposed behind the first writing surface and slides within the second slot.

10. The convertible table of claim 1, further comprising:

a first lock;

a second lock, wherein when the convertible table is in the second position, a first lock is in a locked position such that a first pin extends from a first side of the frame member and into a first receiving hole in the first leg, and a second lock is in a locked position such that a second pin extends from a second side of the frame member and into a second receiving hole in the second leg.

11. The convertible table of claim 1 further comprising:

a first tray attached to the top end of the first base leg and the top end of the second base leg, the first tray extending from the top end of the first base leg and the top end of the second base leg along a first plane that is parallel to the first axis and the second axis, wherein the first tray is disposed below the frame member and is located below a bottom end of the first leg and a bottom end of the second leg in the second position.

12. The convertible table of claim 1, further comprising:

a plurality of recesses formed within one of an inner surface of the first base leg and an inner surface of the second base leg.

13. The convertible table of claim 1, further comprising:

a first rotational bar extending within the first end of the frame member between the first surface and the second surface, a first end of the first rotational bar extending through a first side of the frame member to rotatably connect the frame member to the top end of the first base leg, and a second end of the first rotational bar extending through a second side of the frame member to rotatably connect the frame member to the top end of the second base leg.

14. The convertible table of claim 13 further comprising:

a second rotational bar extending within the second end of the frame member between the first surface and the second surface, a first end of the second rotational bar extending through the first side of the frame member to rotatably connect the frame member to the top end of the first leg, and a second end of the second rotational bar extending through the second side of the frame member to rotatably connect the frame member to the top end of the second leg.

* * * * *